US005172762A

United States Patent [19]

Shinmura et al.

[11] Patent Number: 5,172,762

[45] Date of Patent: Dec. 22, 1992

[54] HEAT EXCHANGER

[75] Inventors: Toshiharu Shinmura, Iseaki; Nobuyasu Ando, Takasaki; Hisao Aoki, Maebashi; Naoyoshi Sutou, Takasaki, all of Japan

[73] Assignee: Sanden Corporation, Gunma, Japan

[21] Appl. No.: 600,869

[22] Filed: Oct. 22, 1990

[30] Foreign Application Priority Data

| | | | |
|---|---|---|---|
| Oct. 20, 1989 | [JP] | Japan | 1-122951[U] |
| Oct. 20, 1989 | [JP] | Japan | 1-122953[U] |
| Oct. 20, 1989 | [JP] | Japan | 1-272968 |
| Feb. 2, 1990 | [JP] | Japan | 2-23892 |
| Mar. 7, 1990 | [JP] | Japan | 2-23039[U] |

[51] Int. Cl.[5] ..... F28F 9/02

[52] U.S. Cl. ..... 165/173; 165/67; 165/175; 165/153; 29/890.052; 29/890.043

[58] Field of Search ..... 165/178, 173, 175, 153; 29/890.052, 890.043

[56] References Cited

U.S. PATENT DOCUMENTS

| | | | |
|---|---|---|---|
| 1,583,758 | 5/1926 | White | 165/178 |
| 3,757,855 | 9/1973 | Kun et al. | 165/175 |
| 4,770,240 | 9/1988 | Dawson et al. | 165/178 |
| 4,945,635 | 8/1990 | Nobusue et al. | 165/173 |
| 4,969,512 | 11/1990 | Hisao et al. | 165/175 |

FOREIGN PATENT DOCUMENTS

| | | | |
|---|---|---|---|
| 2010517 | 2/1970 | France | 165/175 |
| 944094 | 12/1963 | United Kingdom | 165/173 |

*Primary Examiner*—Albert W. Davis, Jr.
*Attorney, Agent, or Firm*—Baker & Botts

[57] ABSTRACT

A heat exchanger includes a pair of header pipes, tubes disposed between the header pipes, and radiation fins provided along the tubes. Each of the header pipes has a plurality of connection holes for the tubes. Each of the header pipes is formed by bending a longitudinal flat plate in the form of a pipe and connecting the side edge portions of the bent plate to each other. The side edge portions of the bent longitudinal plate have connecting portions which are connected to each other with a junction area larger than the cross-sectional area defined by the thickness and length of each header pipe at a position other than the side edge portions. The connection holes are processed before the longitudinal flat plate is bent, and therefore, can be easily and precisely formed at desired positions. The manufacture of the heat exchanger can be simplified and the cost for the manufacture can be reduced. The connection strength of the side edge portions can be increased by the larger connection area of the connecting portions. The strength of the header pipe can be maintained over a long period of time.

6 Claims, 11 Drawing Sheets

HEAT EXCHANGER

BACKGROUND OF THE INVENTION

1. Field of the Invention

The present invention relates to a heat exchanger for use as an evaporator or a condenser for an air conditioner, a radiator or heater core for vehicle, or other type heat exchanger. The invention further relates to methods for manufacturing header pipes of a heat exchanger and for connecting the header pipes and tubes in the heat exchanger.

2. Description of the Prior Art

FIGS. 17 and 18 show a typical conventional heat exchanger which allows heat to exchange between a heat exchange medium (for example, a cooling medium or a brine) flowing in the heat exchanger and air passing through the heat exchanger. A heat exchanger 21, as shown in FIG. 17, is comprised of a pair of header pipes 22 extending in parallel relation to each other, a plurality of tubes 23 disposed between the header pipes and connected to the header pipes at their end portions with a predetermined pitch in the vertical direction, a plurality of radiation fins 24 provided on the sides of the tubes, and a pair of reinforcement members 25 disposed on the top and bottom radiation fins.

Each header pipe 22 is constructed from an welded aluminium pipe. A plurality of connection holes 26 are formed on the periphery of the header pipe 22 with a predetermined pitch in the axial direction of the header pipe. The end portion of each tube 23 is inserted into a corresponding connection hole 26 so that the inside of the tube communicates with the inside of the header pipe 22. Both ends of each header pipe 22 are closed by caps 27. An inlet tube (not shown) for introducing the heat exchange medium into heat exchanger 21 is connected to one of the header pipes 22, and an outlet tube (not shown) for delivering the heat exchange medium out from heat exchanger 21 is connected to the other header pipe.

Each tube 23 is formed as a straight tube which is flattened in the horizontal direction. The end portions of tube 23 are inserted into connection holes 26 of header pipes 22, and fixed therein by, for example, brazing. Corrugate type radiation fins 24 are fixed on the upper and lower surfaces of each tube 23 by, for example, brazing.

The heat exchanger is manufactured, for example, in the following manner.

Welded pipes, formed as header pipes 22, are prepared. A plurality of connection holes 26, each having substantially the same shape as the peripheral shape of tubes 23, are formed on each welded pipe with a predetermined pitch in the axial direction of the welded pipe. Tubes 23 and radiation fins 24 are then arranged in order on the header pipes. Both end portions of the arranged tubes 23 are inserted into corresponding connection holes 26 of header pipes 22. Once the components are positioned, the portions to be connected are secured together by, for example, brazing.

The connection holes 26 in such a conventional heat exchanger are processed on the periphery of the welded pipe, formed as header pipe 22, after the welded pipe is made. This practice, due to the shape of the welded pipe, requires the use of a special jig or tool for processing the holes. This operation causes the manufacturing of the header pipe to be expensive. Consequently, difficulty is had in producing heat exchangers inexpensively. In addition, since it is generally difficult to form connection holes 26 precisely at predetermined positions on the periphery of welded pipe having a circular cross section, defects are liable to occur while inserting and connecting tubes 23 into the header pipes 22. Furthermore, the welded pipe is made merely by bending a flat plate in the form of a pipe and welding the side edges of the bent plate to each other. In this construction, the welded portion generally does not have a high strength, particularly against pressure. Therefore, cracks due to a high pressure fluid passing through the header pipes are liable to occur on the welded portion during use of the heat exchanger over a long period of time.

FIG. 19 shows another conventional heat exchanger 31 which comprises a pair of header pipes 22 with caps 27, a plurality of tubes 23, a plurality of radiation fins 24 and a pair of reinforcement members 25. In addition, heat exchanger 31 includes brackets 32, attached to the upper and lower portions of each header pipe, for supporting the heat exchanger. Each bracket 32 has a U-shaped slot **32*a* at its one end portion. The curved portion 32*b* of bracket 32 formed at other end portion is attached onto the periphery of header pipe 22** by, for example, torch brazing or tig welding.

In such a conventional heat exchanger, brackets 32 are attached to header pipes 22 after the header pipes 22 are made. As a result, many members for construction of the heat exchanger are necessary. Moreover, because the attachment of brackets 32 onto the peripheries of header pipes 22 is troublesome, it is difficult to produce the heat exchanger inexpensively. In addition, since brackets 32 are attached directly to header pipes 22, a corrosion (an electrocorrosion) is likely to occur at the attachment portion. If such a corrosion occurs, the rigidity of header pipes 22 decreases.

SUMMARY OF THE INVENTION

Accordingly, an object of the present invention is to provide a heat exchanger which can be inexpensively produced by an improved method for manufacturing the header pipes and a simple process which can easily form a plurality of connection holes on the header pipes.

Another object of the present invention is to provide: a heat exchanger where the connection holes can be easily formed at desired positions and tubes can be precisely connected to header pipes in a desired state; and a method for manufacturing the header pipes and connecting the tubes thereto in such a heat exchanger.

A further object of the present invention is to provide a heat exchanger which can decrease the number of members needed for construction of the heat exchanger, and thereby simplify the operation for manufacture of the heat exchanger and reduce the cost thereof.

A still further object of the present invention is to provide a heat exchanger which can maintain the rigidity and strength of the header pipes at high values over a long period of time.

To achieve these objectives, a heat exchanger according to the present invention is herein provided. The heat exchanger includes a pair of header pipes each formed by bending a longitudinal flat plate in the form of a pipe and connecting side edge portions of the bent longitudinal plate to each other, a plurality of tubes disposed between the pair of header pipes and connected to the pair of header pipes at their end portions, and a plurality of fins provided along sides of the tubes. The side edge portions of the bent longitudinal plate have connecting portions which are connected to each other with a junction area larger than the area defined by the thickness and length of the remaining portions of each of the header pipes.

In a heat exchanger according to an embodiment of the present invention, at least one of the connecting portions has a bracket portion for mounting the heat exchanger to a supporting structure.

A method for manufacturing a header pipe of a heat exchanger according to the present invention comprises the steps of defining a plurality of connection holes on a longitudinal flat plate, bending the longitudinal flat plate with the connection holes in the form of a pipe, and connecting side edge portions of the bent longitudinal plate to each other.

A method for manufacturing a header pipe and connecting the header pipe and a plurality of tubes in a heat exchanger according to the present invention comprises the steps of defining a plurality of connection holes on a longitudinal flat plate, inserting the plurality of tubes into the defined connection holes, respectively, bending the longitudinal flat plate in the form of a pipe after the plurality of tubes are inserted into the connection holes, and connecting side edge portions of the bent longitudinal plate to each other.

In a heat exchanger according to the present invention, the header pipe is formed by bending the longitudinal flat plate with the connection holes in the form of a pipe and connecting the connecting portions formed on the side edge portions of the bent longitudinal plate to each other. Since the connecting portions connected to each Other have a junction area larger than the section area of the remaining portions of the header pipe, the strength of the connected portion is increased in comparison with a mere welded pipe used for conventional header pipes. Therefore, the header pipes possess a high rigidity and strength, so that cracks can be prevented from occurring on the connected portion even if the heat exchanger is used with a high pressure fluid over a long period of time.

In a method for manufacturing a header pipe of a heat exchanger according to the present invention, connection holes are processed on a longitudinal flat plate before the flat plate is bent in the form of a pipe. As a result, the processing is very easy because a special jig or tool is not required for the processing. Moreover, the connection holes can be precisely formed at desired positions, because the connection holes are processed on the plane of the flat plate rather than on a cylindrical pipe (i.e., a welded pipe) in the conventional method.

In a method for manufacturing a header pipe and connecting a plurality of tubes thereto in a heat exchanger according to the present invention, the bending of the longitudinal flat tube causes inner edge portions of the connection holes to be curved and pressed onto the peripheries of the tubes which have been already inserted into the connection holes. The inserted tubes are fixed to the bent plates by the pressing. The tubes can be surely fixed to header pipes precisely at desired positions when the bent plates are so formed to the header pipes. Therefore, the connection and fixing of the tubes to the header pipes can be performed easily and precisely.

In a method for manufacturing a heat exchanger in accordance with the present invention, a bracket portion can be formed on at least one of the connecting portions. The bracket portion can be formed, not as a separate member, but as a member formed integrally with at least one of the connecting portions. Therefore, the number of members for construction of the heat exchanger is decreased, the assembly of the members can be simplified, and the cost for manufacturing the heat exchanger can be further reduced.

BRIEF DESCRIPTION OF THE DRAWINGS

Some preferred exemplary embodiments of the invention will now be described with reference to the accompanying drawings, which are given by way of example only, and are not intended to limit the present invention.

DETAILED DESCRIPTION OF PREFERRED EMBODIMENTS OF THE INVENTION

Figure 2:
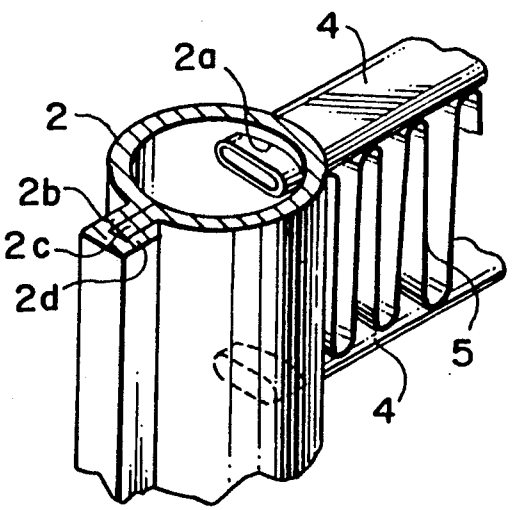
FIG. 2 is an enlarged perspective view of a part, partially cut away, of the heat exchanger shown in FIG. 1.
Figure 1:
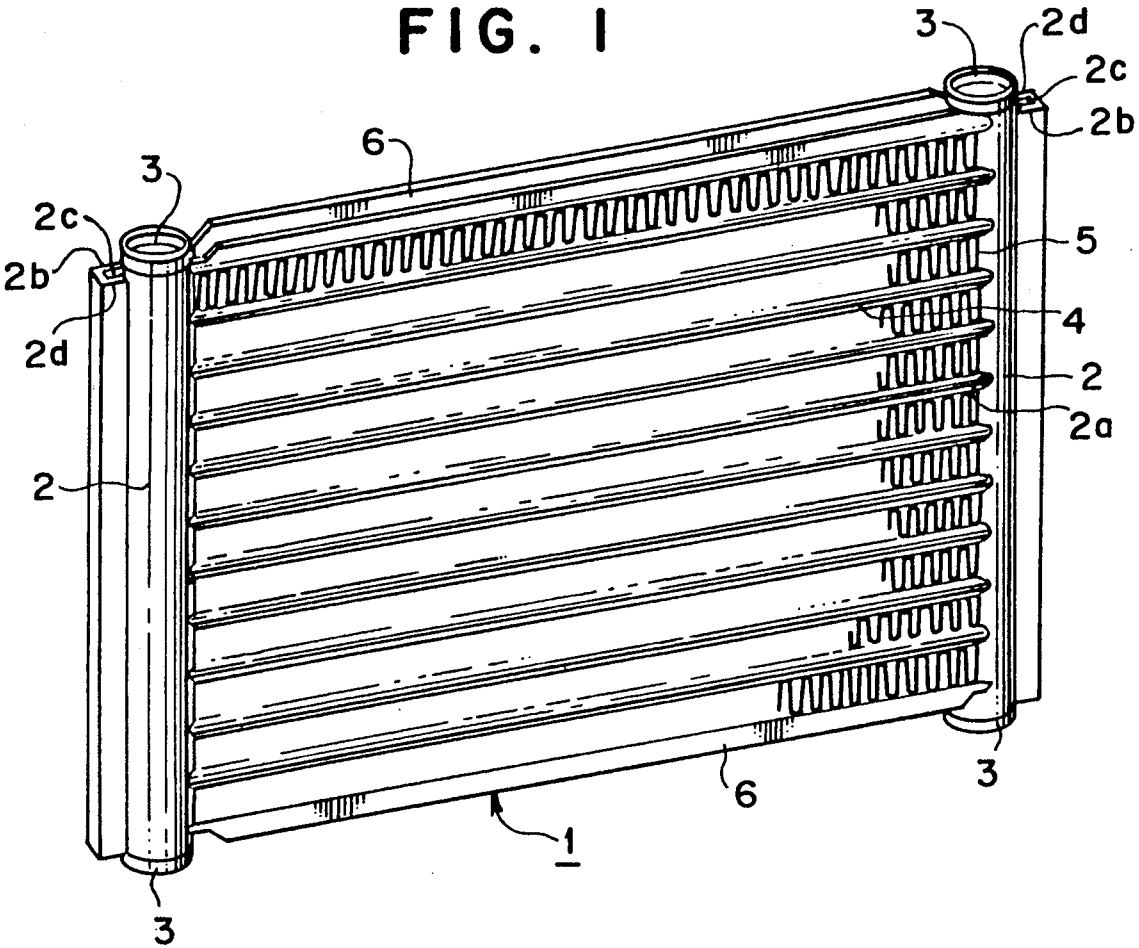
FIG. 1 is a perspective view of a heat exchanger according to a first embodiment of the present invention.

Referring to the drawings, FIGS. 1–3 illustrate a heat exchanger according to a first embodiment of the present invention. In FIG. 1, a heat exchanger 1 has a pair of header pipes 2 extending in parallel relation to each other. Header pipes 2 are closed at both of their end portions by caps 3. A plurality of substantially parallel tubes 4 are disposed between the pair of header pipes 2 with a predetermined pitch in the vertical direction. The tubes 4 are formed as flat tubes in this embodiment. The flat tubes 4 are connected to the pair of header pipes 2 at their end portions. A plurality of corrugate type radiation fins 5 are provided on the sides of tubes 4 and fixed to the tubes by, for example, brazing. Reinforcement members 6 are provided on the upper surface of the top radiation fin 5 and the lower surface of the bottom radiation fin 5, respectively. The reinforcement members 6 are fixed to the upper and lower surfaces of the respective radiation fins and the sides of header pipes 2. A heat medium (for example, a cooling medium or a brine) is introduced through an inlet tube (not shown) connected to one of the header pipes 2, flows through header pipes 2 and tubes 4, and flows out of an outlet tube (not shown) connected to the other header pipe.

Each header pipe 2 has a plurality of connection holes 2*a* with a predetermined pitch arranged in the longitudinal direction of the header pipe. The end portions of tubes 4 are inserted into connection holes 2*a* and fixed to header pipes 2 by brazing. Each header pipe 2 is constructed from a pipe member which is formed by bending a longitudinal aluminium flat plate clad with a brazing material in the form of a pipe, as shown in FIG. 2. Header pipe 2 has connecting portions 2*b* and 2*c* formed on side edge portions of the longitudinal flat plate before the longitudinal flat plate is bent in the form of a pipe. Connecting portions 2*b* and 2*c* are formed by folding the side edge portions of the longitudinal flat plate nearly at right angles. Connecting portions 2*b* and 2*c* abut one another and are connected together by brazing. An extending folded portion 2*d*, which is L-shaped, is formed on the end of connecting portion 2*b*. Extending folded portion 2*d* and connecting portion 2*b* cooperatively retain connecting portion 2*c* between the connecting portion 2*b* and the extending folded portion 2*d*.

Header pipe 2 is manufactured in the manner shown in FIGS. 3A–3D.

Figure 3D:
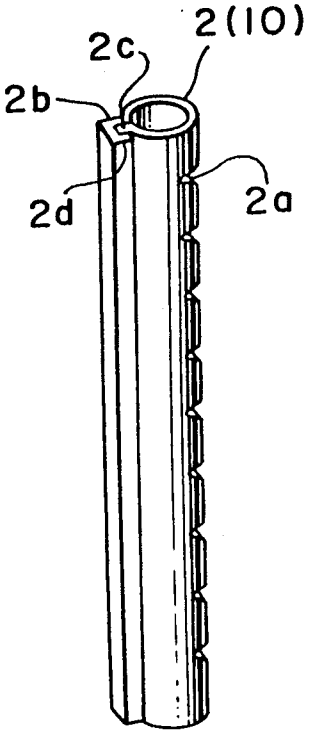
FIGS. 3A to 3D are perspective views of a plate to be formed as the header pipe of the heat exchanger shown in FIG. 1, showing a method for manufacturing a header pipe according to the present invention.
Figure 3C:
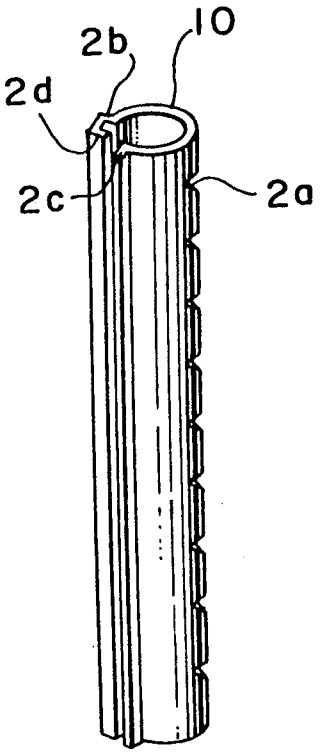
Figure 3B:
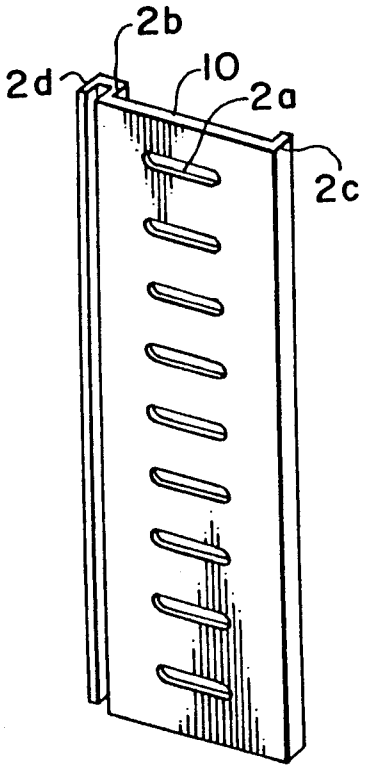
Figure 3A:
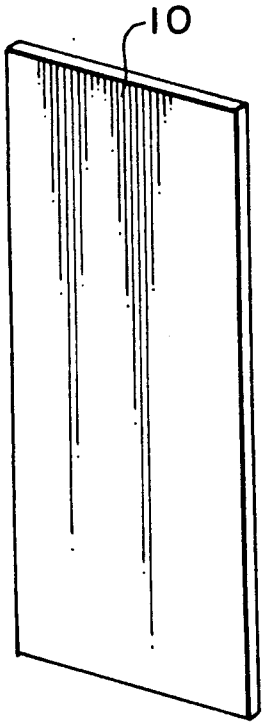

A longitudinal flat plate 10 clad with a brazing material on one or both of the surfaces of the plate is prepared, as shown in FIG. 3A.

A plurality of slots 2*a*, which are to be formed as connection holes and whose length is slightly greater than the width of each tube 4, are defined with a predetermined pitch in the longitudinal direction of the plate, as shown in FIG. 3B. The connection holes can be formed by, for example, punching. At the same time or thereafter, the side edge portions of the longitudinal flat plate 10 are folded to form connecting portions 2*b* and 2*c*. Connecting portion 2*b* is formed longer than connecting portion 2*c*. Extending folded portion 2*d* is formed on the end of the connecting portion 2*b* by folding, at two stages, the projected portion of the connecting portion 2*b* to be L-shaped. Subsequently, the longitudinal flat plate 10 is bent in the form of a pipe, as shown in FIG. 3C. This bending is performed, for example, by using a core rod and winding and pressing the longitudinal flat plate 10 onto the core rod. After connecting portion 2*c* is bent slightly inside of connecting portion 2*b*, the connecting portion 2*c* is inserted into the space formed between the connecting portion 2*b* and extending folded portion 2*d*. Thereafter, connecting portions 2*b* and 2*c* are brazed to each other in the state of plane contact. Thus, header pipe 2, as shown in FIG. 3D, is manufactured.

In the above manufacturing process, connecting portions 2*b* and 2*c* along with other members of the heat exchanger may be brazed together at substantially the same time in a furnace. The projecting portion to be formed as extending folded portion 2*d* may be folded after connecting portions 2*b* and 2*c* are joined to each other.

In the manufacture of heat exchanger 1, caps 3, tubes 4 radiation fins 5 and reinforcement members 6 are assembled to a pair of header pipes 2 obtained as shown in FIG. 3D. Preferably, the assembly is brazed in a furnace all at one time.

In the manufacture of heat exchanger 1, connection holes 2*a* are processed on a longitudinal flat plate 10 before the longitudinal flat plate 10 is bent in the form of a pipe. In this way the connection holes 2*a* are easily formed without a special jig or tool. Further, connections holes 2*a* are precisely formed to a required shape and at desired positions. Therefore, the heat exchanger 1 can be inexpensively produced.

Moreover, since tubes 4 can be easily inserted into and connected to connection holes 2*a*, which are formed at a high accuracy with a desired state, the operational efficiency of manufacturing a heat exchanger 1 can be increased. Additionally, a high quality heat exchanger 1 can be obtained.

Furthermore, connecting portions 2*b* and 2*c* are connected to each other with a junction area which is larger than the cross-sectional areas defined by other portions of header pipe 2 at positions other than the side edge portions of the longitudinal flat plate 10. In other words, connecting portions 2*b* and 2*c* are connected to each other with a connection length greater than the thickness of header pipe 2 at positions other than the connecting portions 2*b* and 2*c*. Therefore, with a broader connection area, the strength and durability of the connection between the connecting portions 2*b* and 2*c* is greatly increased. As a result, cracks or the like ca be prevented from occurring along the connection portion of connecting portions 2*b* and 2*c*, even if the heat exchanger is used for a long period of time or a high pressure fluid flows through header pipes 2. In the above embodiment, the connection strength of the connecting portions 2*b* and 2*c* is further increased by holding connecting portion 2*c* between connecting portion 2*b* and extending folded portion 2*d*.

In the manufacture of header pipe 2 and connection of the header pipes and tubes 4, the insertion of the tubes 4 into connection holes 2*a* may be performed before longitudinal flat plate 10 is bent in the form of a pipe.

Figure 4A:
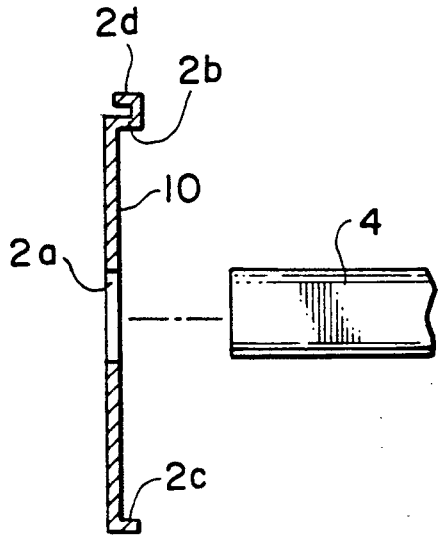
FIGS. 4A to 4C are plan views, partially illustrating a cross section of a plate to be formed as a header pipe and a tube of a heat exchanger, showing a method for manufacturing a header pipe and connecting a plurality of tubes thereto in a heat exchanger according to the present invention.
Figure 4B:
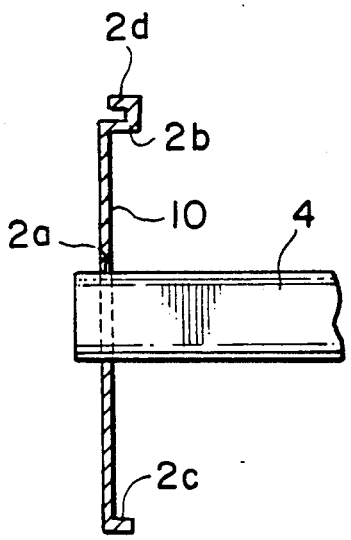
Figure 4C:
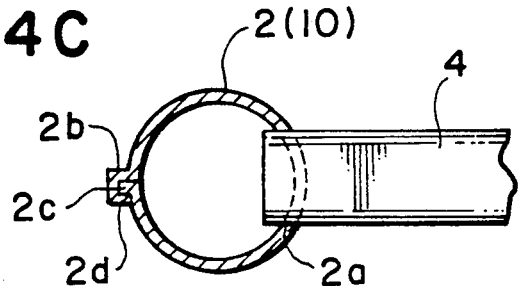

More specifically, as shown in FIG. 4A, a plurality of connection holes 2a are formed on a longitudinal flat plate 10. Connecting portions 2b and 2c and extending folded portion 2d are formed on the side edge portions of the longitudinal flat plate 10. In this state, the end portions of tubes 4 are inserted into corresponding connection holes 2a, respectively, as shown in FIG. 4B. Subsequently, longitudinal flat plate 10 is bent in the form of a pipe, as shown in FIG. 4C. In this bending operation, the inner edges of connection holes 2a are pressed onto the peripheries of the inserted tubes 4. Therefore, the tubes 4 are fixed to header pipe 2 as if the tubes are calked by the inner edges.

In this embodiment, the inserted tubes 4 are fixed (in a temporary fixing) to the bent plate 10 by pressing the inner edges of connection holes 2a onto the peripheries of the inserted tubes 4. This arrangement retains the inserted tubes 4 in the bent plate 10 until the time when the bent plate 10 is formed as header pipe 2 by, for example, brazing in a furnace. Therefore, tubes 4 can be fixed to the header pipes 2 precisely at desired positions and in a desired state. This process alleviates the risk of dislocating the connection of tubes 4 and header pipes 2 before brazing, as well as substantially eliminating the defects which accompany the conventional brazing of the tubes 4 and header pipes 2.

Figure 5A:
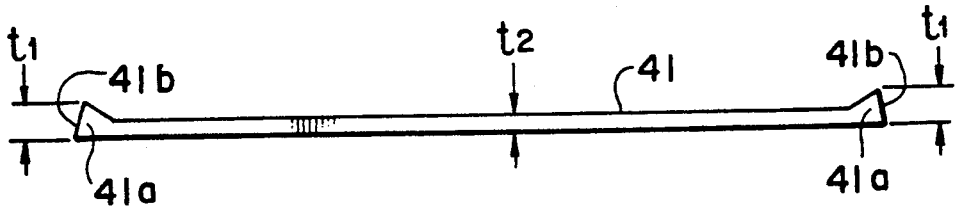
FIGS. 5A and 5B are plan views of a plate to be formed as a header pipe of a heat exchanger according to a modification of the first embodiment of the present invention.
Figure 5B:
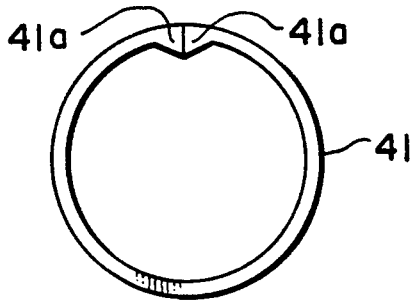

FIGS. 5A and 5B illustrate a modification of the method for manufacturing a header pipe shown in FIGS. 3A-3D.

In this embodiment, the side edge portions 41a of a longitudinal flat plate 41 are formed as thick portions whose thickness $t_1$ is greater than the thickness $t_2$ of the other portions of the plate. The tapered surfaces 41b are brought into contact with each other and connected to each other, after longitudinal flat plate 41 is bent in the form of a pipe.

Since tapered surfaces 41b are connected to each other in an abutting relationship with a junction area larger than the cross sectional area of the other portions of the plate, the connection portion can have a great strength, similarly to that in the first embodiment.

Figure 6A:
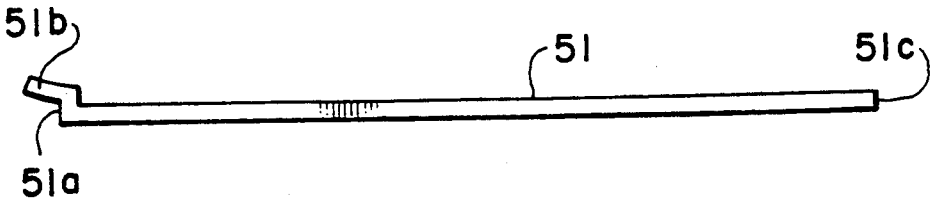
FIGS. 6A and 6B are plan views of a plate to be formed as a header pipe of a heat exchanger according to another modification of the first embodiment of the present invention.
Figure 6B:
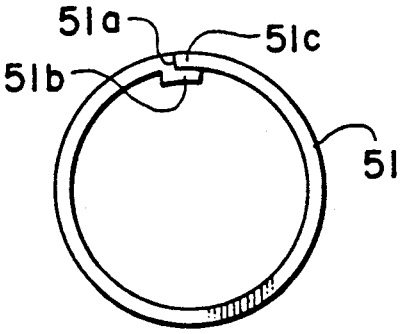

FIGS. 6A and 6B illustrate another modification of the method for manufacturing a header pipe shown in FIGS. 3A-3D.

In this embodiment, a stepped portion 51a and a curved portion 51b extending from the stepped portion 51a are formed on one of the side edge portions of a longitudinal flat plate 51. When the longitudinal flat plate 51 is bent in the form of a pipe, the terminal edge of the other side edge portion 51c of the plate is brought into contact with the stepped portion 51a and the inner surface of the end portion of the other side edge portion 51c is brought into contact with the outer surface of the curved portion 51b.

Since both of the side edge portions of the longitudinal flat plate 51 are abuttingly connected with a broad connection area, the connection portion can have a great strength similarly to that in the first embodiment.

Figure 7A:
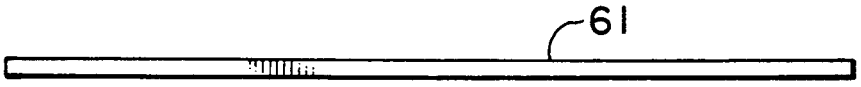
FIGS. 7A and 7B are plan views of a plate to be formed as a header pipe of a heat exchanger according to a further modification of the first embodiment of the present invention.
Figure 7B:
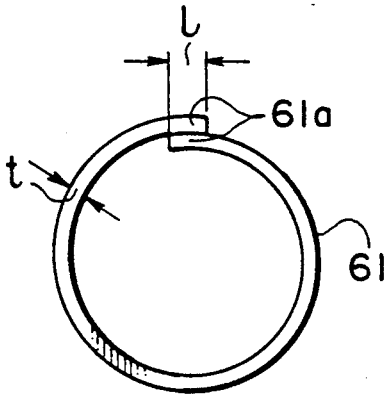

FIGS. 7A and 7B illustrate a further modification of the method for manufacturing a header pipe shown in FIGS. 3A-3D.

In this embodiment, a longitudinal flat plate 61 is bent in the form of a pipe. However, side edge portions 61a (connecting portions) are overlapped with each other to form a junction length (l) larger than the thickness (t) of the other portions of the plate.

Since the connecting portions 61a are connected to each other in an abutting relationship with a junction area larger than the cross sectional area of the other portions of the plate, the connection portion can have a great strength similarly to that in the first embodiment.

Figure 8:
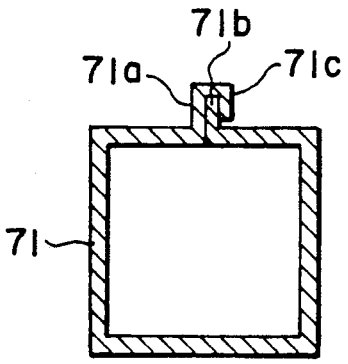
FIG. 8 is a cross sectional view of a header pipe of a heat exchanger according to a modification of the first embodiment of the present invention.

FIG. 8 illustrates a modification of the header pipe shown in FIGS. 1-3D.

In this embodiment, header pipe 71 is formed as a rectangle in cross section. The header pipe 71 is formed by folding a longitudinal flat plate provided with connecting portions 71a and 71b and extending folded portion 71c. Thus, the shape of the cross section of a header pipe according to the present invention is not restricted to a circle, and a rectangle or other shapes may be employed.

Figure 9:
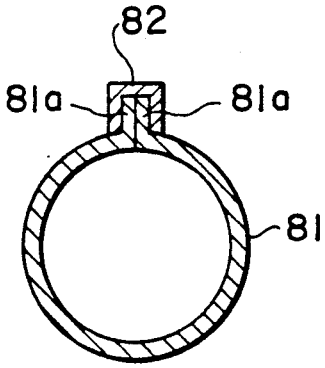
FIG. 9 is a cross sectional view of a header pipe of a heat exchanger according to another modification of the first embodiment of the present invention.

FIG. 9 illustrates another modification of the header pipe shown in FIGS. 1-3D.

In this embodiment, header pipe 81 has two connecting portions 81a which are formed by folding the side edge portions of a longitudinal flat plate to be formed as a header pipe. Both connecting portions 81a have substantially the same shape. A retainer 82 is fitted over the connecting portions 81a abutted against each other for retaining the connecting portions 81a and reinforcing the connection of the connecting portions 81a.

Figure 10:
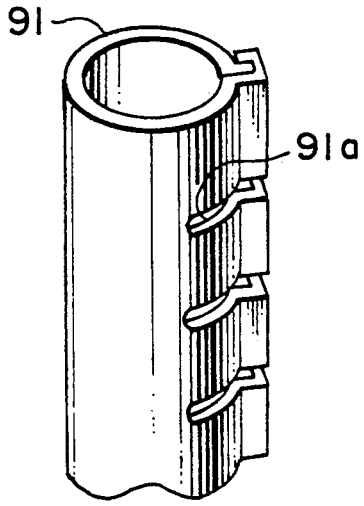
FIG. 10 is a partial perspective view of a header pipe of a heat exchanger according to a further modification of the first embodiment of the present invention.

FIG. 10 illustrates a further modification of the header pipe shown in FIGS. 1-3D.

In this embodiment, a plurality of U-shaped slots 91a are defined on and arranged along at least one edge of a longitudinal flat plate to be formed as a header pipe 91. The U-shaped slots 91a form connection holes of the header pipe 91, when the longitudinal flat plate is bent to form the header pipe 91. In this arrangement, the connection holes of the header pipe 91 are initially notches or the like in the stage of the longitudinal flat plate.

Figure 11:
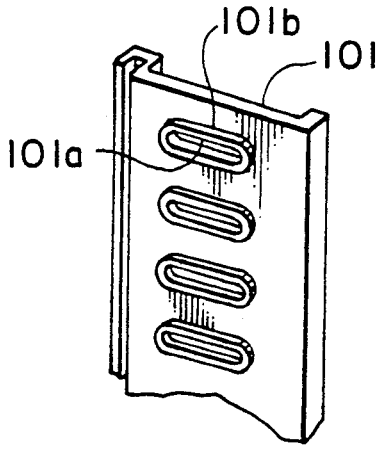
FIG. 11 is a partial perspective view of a plate to be formed as a header pipe of a heat exchanger according to a still further modification of the first embodiment of the present invention.

FIG. 11 illustrates a still further modification of the header pipe shown in FIGS. 1-3D.

In this embodiment, connection holes 101a are formed in a longitudinal flat plate 101 with collars 101b provided on the peripheries of the connection holes 101a. Plate 101 is then bent to form a header pipe, in a manner substantially the same as the first embodiment, so that collars 101b are on the inside of the header pipe. Preferably, in the bending process the core rod would be provided with grooves to accommodate the collars and ensure that they are not adversely deformed The collars 101b can guide and hold the tubes which are inserted into the connection holes 101a.

FIGS. 12-14C illustrate a heat exchanger according to a second embodiment of the present invention.

Figure 12:
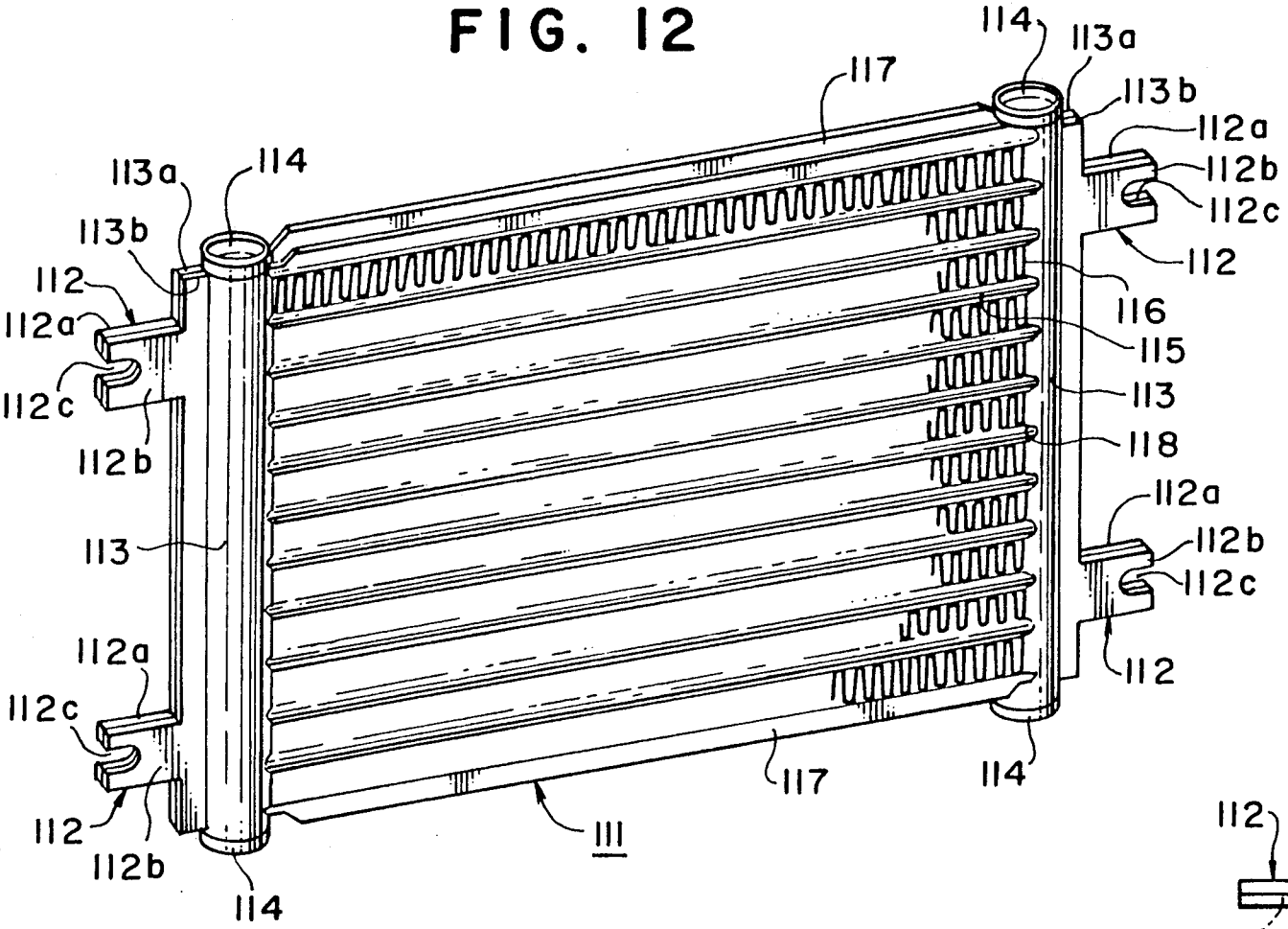
FIG. 12 is a perspective view of a heat exchanger according to a second embodiment of the present invention.

In this embodiment, as shown in FIG. 12, a heat exchanger 111 comprises a pair of header pipes 113 with caps 114, a plurality of tubes 115, a plurality of radiation fins 116, a pair of reinforcement members 117, and bracket portions 112 for mounting the heat exchanger to a supporting structure. Bracket portions 112 are provided on the upper and lower portions of each header pipe 113. Each header pipe 113 has a plurality of connection holes 118 into which the end portions of tubes 115 are inserted. Each bracket portion 112 is formed on at least one of the connecting portions 113a and 113b of each header pipe 113. In this embodiment, each bracket portion 112 is formed from portions 112a and 112b extending outwards from the respective connecting portions 113a and 113b. Each bracket portion 112 has a U-shaped slot 112c opening outwards through which a fastening means (not shown) is inserted. Each portion 112a or 112b of each bracket portion 112 is formed integrally with a corresponding connecting portion 113*a* or 113*b*. Portions 112*a* and 112*b* as well as connecting portions 113*a* and 113*b* are brazed to each other at their surfaces facing each other. The brazed portions 112*a* and 112*b* constitute one bracket portion 112.

Figure 14C:
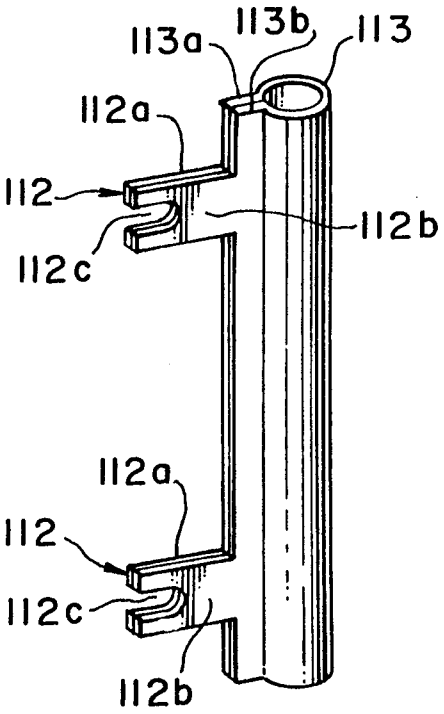
FIGS. 14A to 14C are perspective views of a plate to be formed as the header pipe of the heat exchanger shown in FIG. 12, showing another method for manufacturing a header pipe according to the present invention.
Figure 14B:
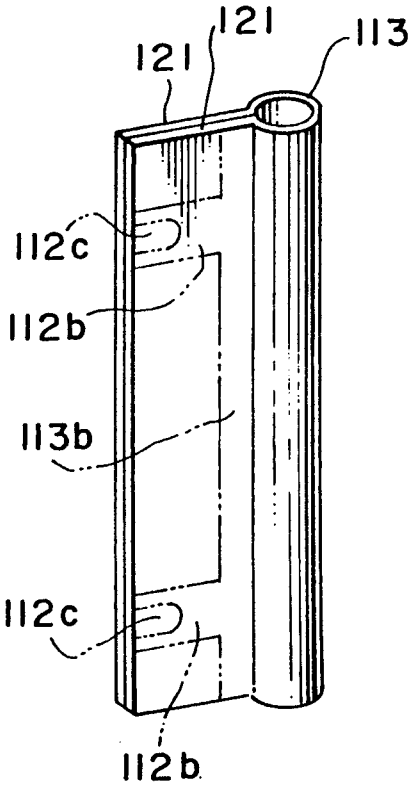
Figure 14A:
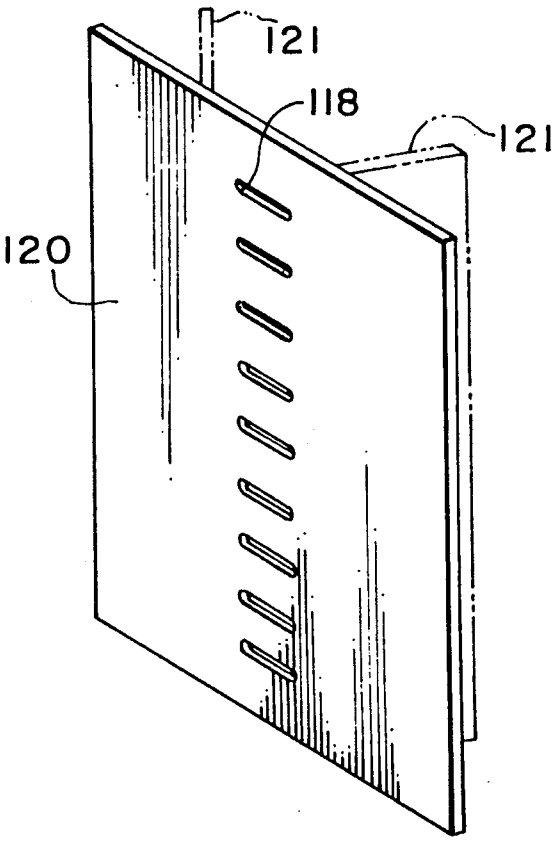

Header pipe 113 is manufactured in the manner shown in FIGS. 14A-14C.

A longitudinal flat plate 120 clad with a brazing material on one or both of the surfaces of the plate is prepared, as shown in FIG. 14A. A plurality of slots 118, which are to be formed as connection holes, are defined with a predetermined pitch in the longitudinal direction of the plate. The connection holes are formed by, for example, punching. At the same time or thereafter, the side edge portions 121 of the longitudinal flat plate 120 are folded with a predetermined width to form connecting portions 113*a* and 113*b* and the material for bracket portions 112 (dashed line).

Subsequently, the longitudinal flat plate 120 is bent in the form of a pipe, as shown in FIG. 14B. This bending is performed, for example, by using a core rod and winding and pressing the longitudinal flat plate 120 onto the core rod. The folded portions 121 are brazed to each other in abutting contact. Brazed folded portions 121 are cut along the dashed line shown in FIG. 14B to form connecting portions 113*a* and 113*b*, portions 112*a* and 112*b* constituting bracket portions 112, and U-shaped slots 112*c*. Thus header pipe 113, as shown in FIG. 14C, is manufactured.

In the above manufacturing process, connecting portions 113*a* and 113*b* and portions 112*a* and 112*b* may be brazed together in a furnace while brazing other members of the heat exchanger, so that all of the brazing is performed at substantially the same time. The connecting portions 113*a* and 113*b* and portions 112*a* and 112*b* may alternatively be formed by cutting longitudinal flat plate 120, before the longitudinal flat plate 120 is bent to a pipe.

In the manufacture of heat exchanger 111, caps 114, tubes 115, radiation fins 116 and reinforcement members 117 are assembled to a pair of header pipes 113 obtained as shown in FIG. 14C, and the assembly is brazed in a furnace at substantially the same time. The heat exchanger 111 thus manufactured is attached to a supporting structure of an air conditioner or vehicle etc., by fastening bolts or the like which are inserted through slots 112*c* of bracket portions 112.

Since bracket portions 112 are formed integrally with header pipes 113 in this embodiment, separate members as bracket portions are not necessary. Therefore, the number of members constituting the heat exchanger is reduced. The manufacturing process of the heat exchanger can thereby be simplified, and the cost for such manufacturing reduced. Moreover, since separate members are not brazed to header pipes, a corrosion (i.e., an electrocorrosion), which is likely to occur at the attachment portion in a conventional heat exchanger, can be prevented.

Furthermore, since portions 112*a* and 112*b* constituting bracket portions 112 are brazed to each other in abutting contact together with connecting portions 113*a* and 113*b*, the connection area can be further broadened and the connection strength increased.

Figure 13:
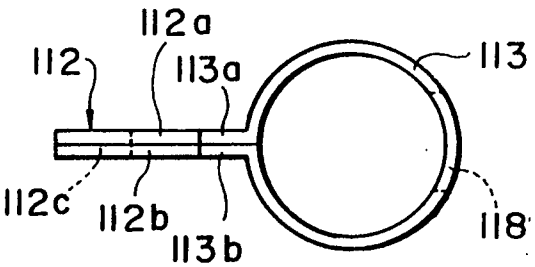
FIG. 13 is an enlarged plan view of a header pipe of the heat exchanger shown in FIG. 12.
Figure 15:
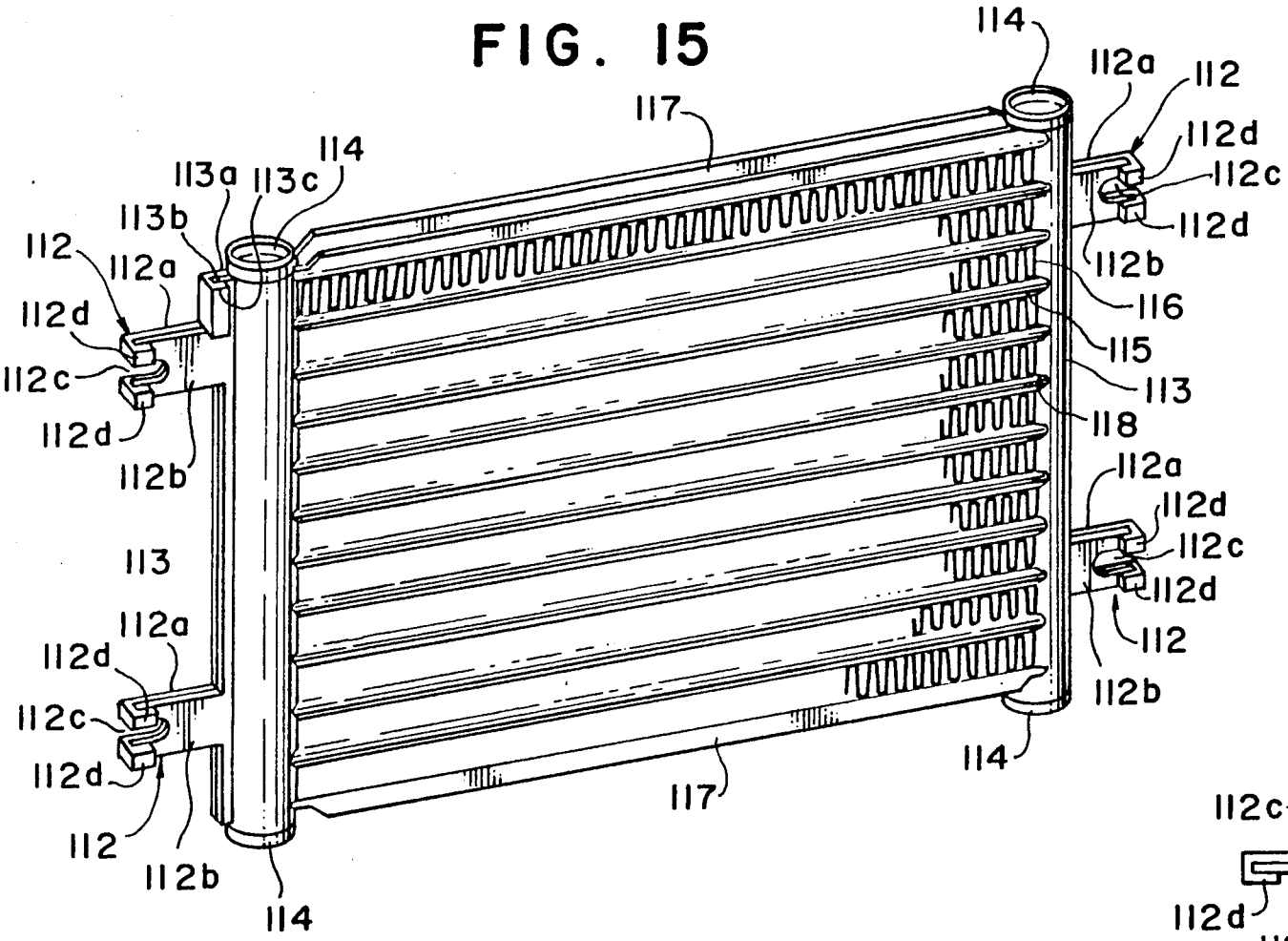
FIG. 15 is a perspective view of a heat exchanger according to a modification of the second embodiment of the present invention.
Figure 16:
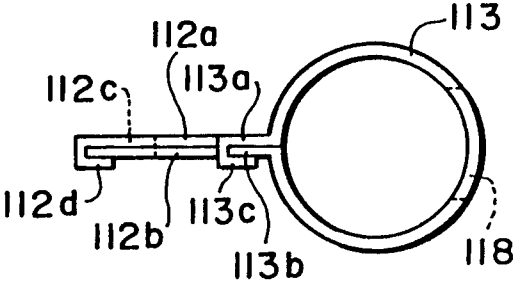
FIG. 16 is an enlarged plan view of a header pipe of the heat exchanger shown in FIG. 15.
Figure 18:
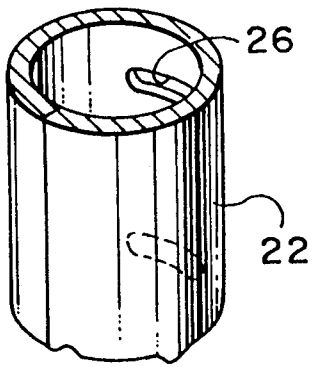
FIG. 18 PRIOR ART
FIG. 18 is an enlarged perspective view of a header pipe, partially cut away, of the heat exchanger shown in FIG. 17.
Figure 17:
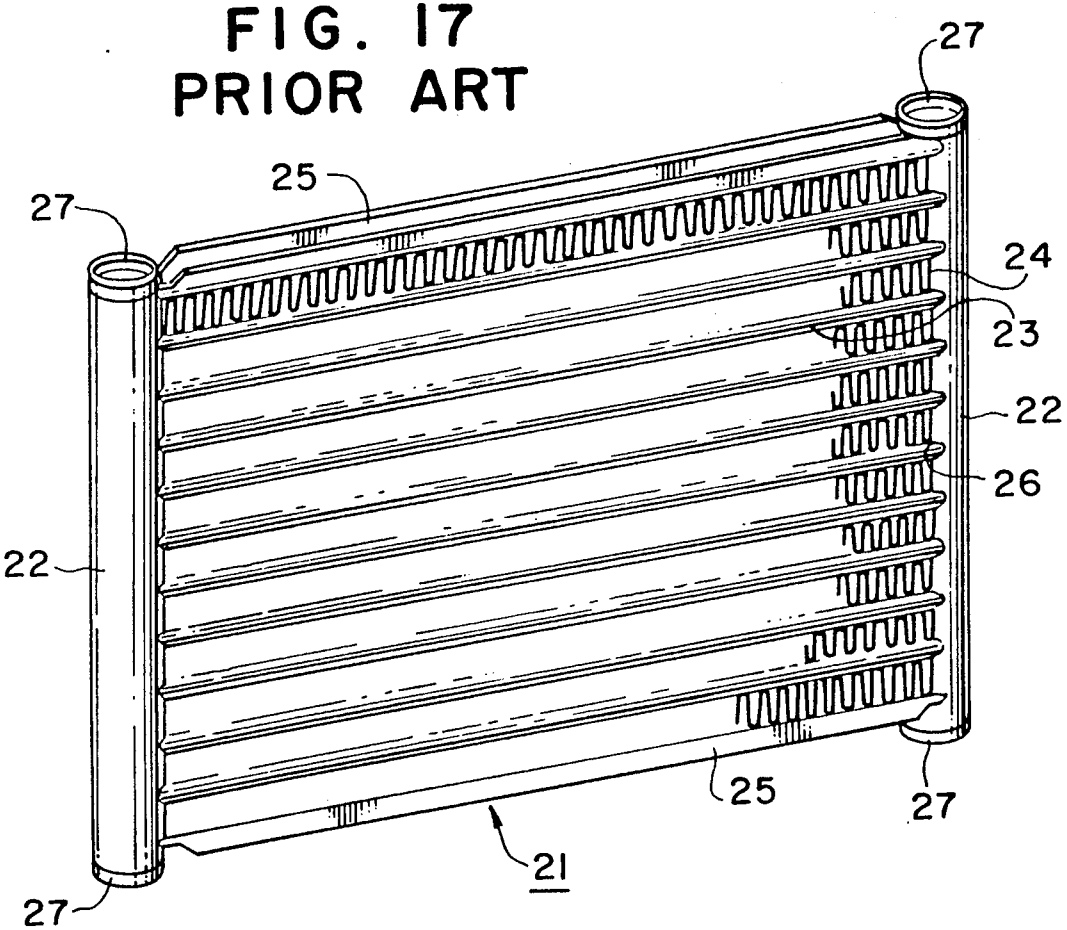
FIG. 17 PRIOR ART
FIG. 17 is a perspective view of a conventional heat exchanger.
Figure 19:
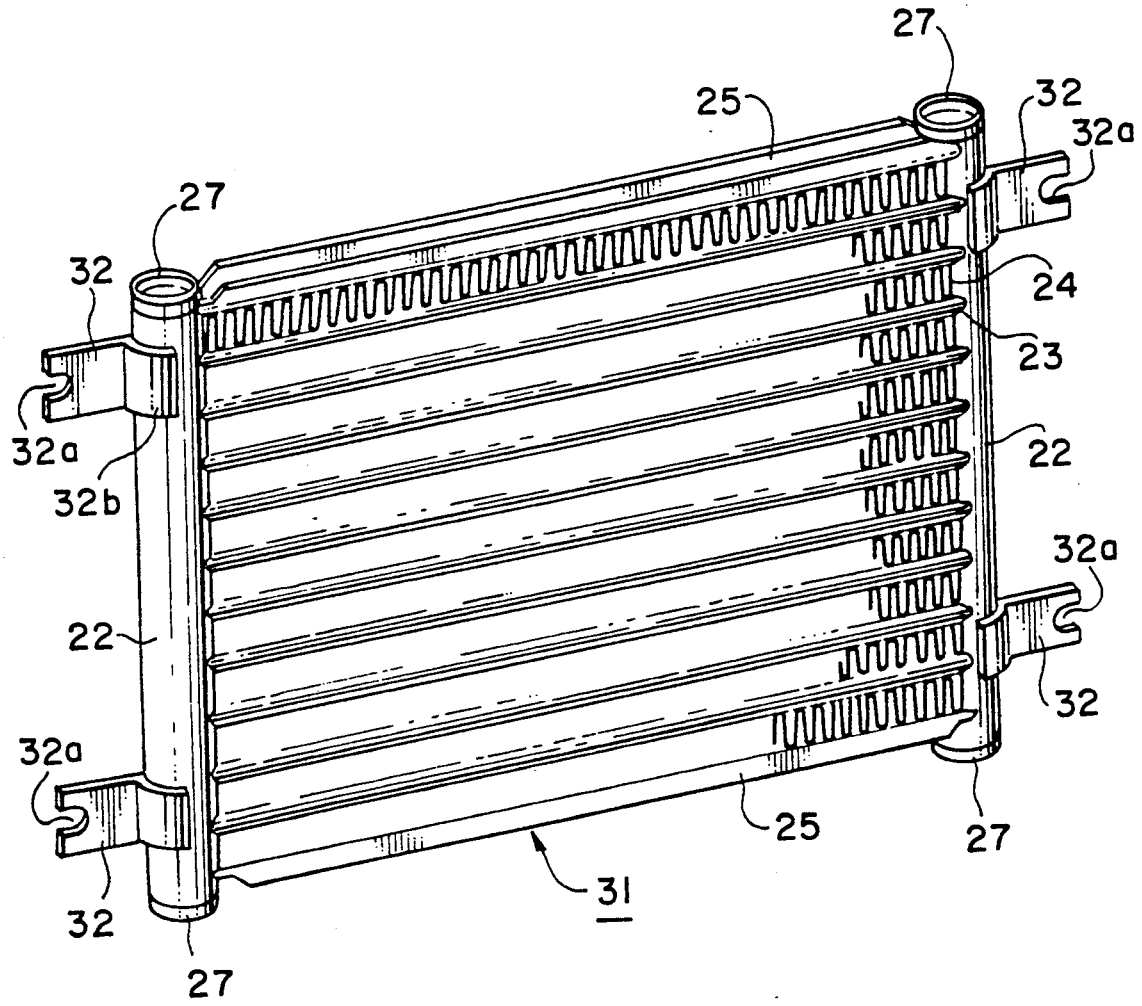
FIG. 19 PRIOR ART
FIG. 19 is a perspective view of another conventional heat exchanger.

FIGS. 15 and 16 illustrate a modification of the heat exchanger shown in FIGS. 12 and 13.

In this embodiment, an extending folded portion 112*d* is provided on each portion 112*a*, and an extending folded portion 113*c* is provided on each connecting portion 113*a*. Other portions have substantially the same structures as those of the heat exchanger shown in FIG. 12.

Since the extending folded portion 112*d* and the extending folded portion 113*c* retains portion 112*b* and connecting portion 113*b*, respectively, the connection strengths between portions 112*a* and 112*b* and between connecting portions 113*a* and 113*b* can be further increased. 112*a* and 112*b* constituting a bracket Although portions 112*a* and 112*b* constituting a bracket portion 112 extend from both of connecting portions 113*a* and 113*b* in the above second embodiment and the modification thereof, the bracket portions may be formed by extending only one of the connecting portions. Further, bracket portions may be formed from the connecting portions 113*a* and 113*b* themselves by forming a part or the entire connecting portions 113*a* and 113*b* slightly wider and forming slots 112*c* on the extended portions thereof.

Although several preferred embodiments of the present invention have been described in detail, it will be appreciated by those skilled in the art that various modifications and alterations can be made to these embodiments without materially departing from the novel teachings and advantages of this invention. Accordingly, it is to be understood that all such modifications and alterations are included within the scope of the invention as defined by the following claims.

What is claimed is:

1. A heat exchanger comprising:

a pair of tubular header pipes having axes which are parallel, each said header pipe having a plurality of axially spaced oblong slots;

a plurality of generally flat tubes extending between said header pipes and individually through said slots, for providing fluid communication between said header pipes;

a plurality of radiation fins extending between adjacent flat tubes; and wherein said header pipes each comprise a single bent rectangular plate member having a plurality of oblong slots, and two side edge connecting portions, wherein one side edge connecting portion comprises an outwardly projecting U-shaped flange portion, and the other side edge connecting portion comprises an outwardly extending flange portion, said flat tubes being received within said slots, wherein said slots of said single bent rectangular plate member are sized to engage and press into said flat tubes to fixedly hold said flat tubes in place, and wherein said U-shaped flange portion of said single bent rectangular plate member extends over and retains the outwardly extending flange portion so that the single bent rectangular plate member forms a tubular header pipe.

2. The heat exchanger according to claim 1 wherein said heat exchanger is brazed to retain said extending folded portion over said other side edge portion.

3. A heat exchanger including at least one tubular header pipe formed from a rectangular plate having a pair of parallel opposed side edge portions which are joined together and at least one slot with sides for attachment of a heat exchange tube, at least one heat exchange tube being connected with said header pipe in fluid communication for effecting the flow of a heat exchange medium through said heat exchanger, and a plurality of fin units provided along the outside of said heat exchange tube, the improvement comprising said rectangular plate comprising a single bent rectangular plate including one opposed side edge portion having an extended folded portion which interlocks with and retains the other opposed side edge portion to form said tubular header pipe, wherein said slot of said bent rectangular plate is shaped and sized to engage and press into said heat exchange tube to hold it in place.

4. A heat exchanger according to claim 3 wherein said one opposed side edge portion includes an outwardly projecting U-shaped flange and the other side edge portion includes a radially outwardly extending flange, said U-shaped flange receiving said radially outwardly extending flange to form an interlocked seam of said header pipe.

5. A heat exchanger according to claim 3 wherein said header pipe includes at least one oblong slot for reception of said heat exchange tube.

6. A heat exchanger according to claim 3 wherein said heat exchanger is brazed to retain said opposed side edge portions in said interlocked position.

* * * * *